US005644804A

United States Patent [19]

Wang

[11] Patent Number: 5,644,804

[45] Date of Patent: Jul. 8, 1997

[54] SOFABED

[75] Inventor: Chi-Jung Wang, Chia-Yi Hsien, Taiwan

[73] Assignee: Chung-Chin Chen, Alexandria, Va.

[21] Appl. No.: 590,429

[22] Filed: Jan. 23, 1996

[51] Int. Cl.[6] ..... A47C 17/16; A47C 17/18

[52] U.S. Cl. ..... 5/12.1; 5/18.1; 5/37.1

[58] Field of Search ..... 5/12.1, 18.1, 19, 5/37.1, 38, 43

[56] References Cited

U.S. PATENT DOCUMENTS

| | | | |
|---|---|---|---|
| 571,000 | 11/1896 | Jackson | 5/12.1 |
| 898,399 | 9/1908 | Albert | 5/38 |
| 907,468 | 12/1908 | Crouch | 5/37.1 |
| 3,837,019 | 9/1974 | Hoff | 5/98.1 |
| 3,949,434 | 4/1976 | Anacker | 5/12.1 |
| 4,765,542 | 8/1988 | Carlson | 5/928 |
| 5,271,109 | 12/1993 | Markel et al. | 5/37.1 |

FOREIGN PATENT DOCUMENTS

| | | | |
|---|---|---|---|
| 2484231 | 12/1981 | France | 5/19 |

*Primary Examiner*—Steven N. Meyers
*Assistant Examiner*—Robert G. Santos
*Attorney, Agent, or Firm*—Bacon & Thomas

[57] ABSTRACT

A sofabed which includes a first base frame serving as the seat of a sofa or the bed piece of a bed and defining a space for keeping pillows, quilts, etc., a second base frame retractably connected to the first base frame and moved between the retracted position received inside tile first base frame and the extended position to serve as the base frame of a second bed, a seat frame supported on the first base frame, a second seat frame pivoted to the first base frame and set at the desired angle to serve as the back of the sofa the bed piece of the second bed, and two armrest frames adjustably connected to the first base frame at two opposite ends.

4 Claims, 5 Drawing Sheets

SOFABED

BACKGROUND OF THE INVENTION

The present invention relates to sofabeds, and relates more particularly to a simple structure of sofabed which can be alternatively arranged into a sofa, a single bed, or twin beds, and which has a space for keeping a quilt, pillow, etc.

The frame assembly of a regular sofabed is generally comprised of a plurality of frame tubes and an angle adjustment device respectively connected together by connecting elements such as pins, screws etc. This structure of sofabed has no room for keeping quilt, pillow, etc. Furthermore, this structure of sofabed can only be alternatively arranged into a bed or a sofa, however it cannot be adjusted from a linked twin beds into a single bed.

SUMMARY OF THE INVENTION

The present invention overcomes the aforementioned disadvantages of conventional sofabeds. It is one object of the present invention to provide a sofabed which can be conveniently arranged into a sofa, a single bed, or linked twin beds. It is another object of the present invention to provide a sofabed which has a space for keeping a quilt, pillow, etc. It is still another object of the present invention to provide a sofabed which is simple in structure, and convenient to assemble. According to the preferred embodiment of the present invention, the sofabed comprises a first base frame serving as the seat of a sofa or the bed piece of a bed and defining a space for keeping pillows, quilts, etc., a second base frame retractably connected to the first base frame and moved between the retracted position received inside the first base frame and the extended position to serve as the base frame of a second bed, a seat frame supported on the first base frame, a second seat frame pivoted to the first base frame and set at the desired angle to serve as the back of the sofa or the bed piece of the second bed, and two armrest frames adjustably connected to the first base frame at two opposite ends.

DETAILED DESCRIPTION OF THE PREFERRED EMBODIMENT

Figure 1:
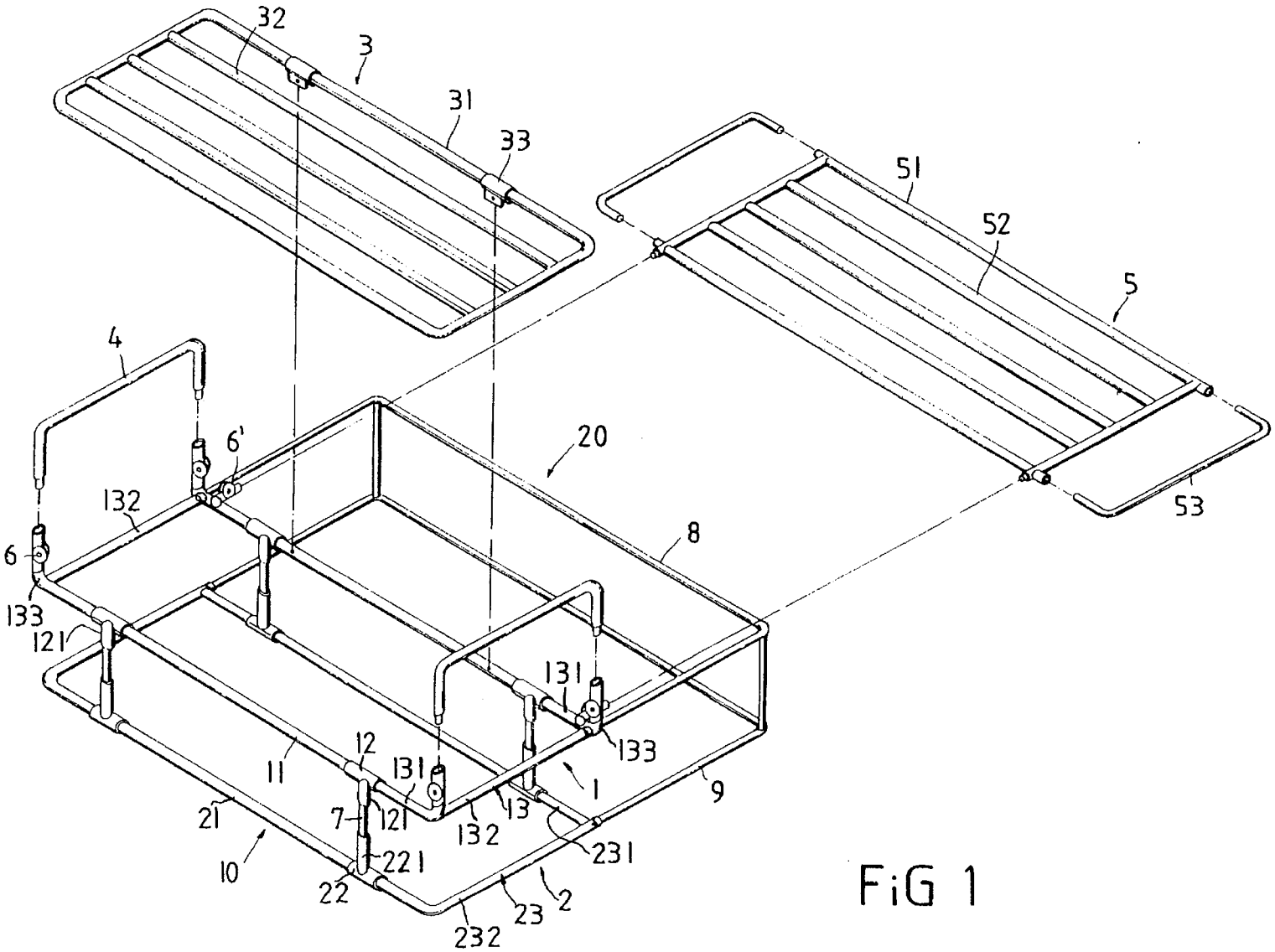
FIG. 1 is an exploded view of the frame assembly of the sofabed according to the preferred embodiment of the present invention.

Referring to FIG. 1, the frame assembly of a sofabed in accordance with the present invention is generally comprised of a first base frame 10, a second base frame 20, a first seat frame 3, a second seat frame 5, two armrest frames 4, and a plurality of connectors 6, 6' The aforesaid frames are respectively made from metal tubes.

Figure 2:
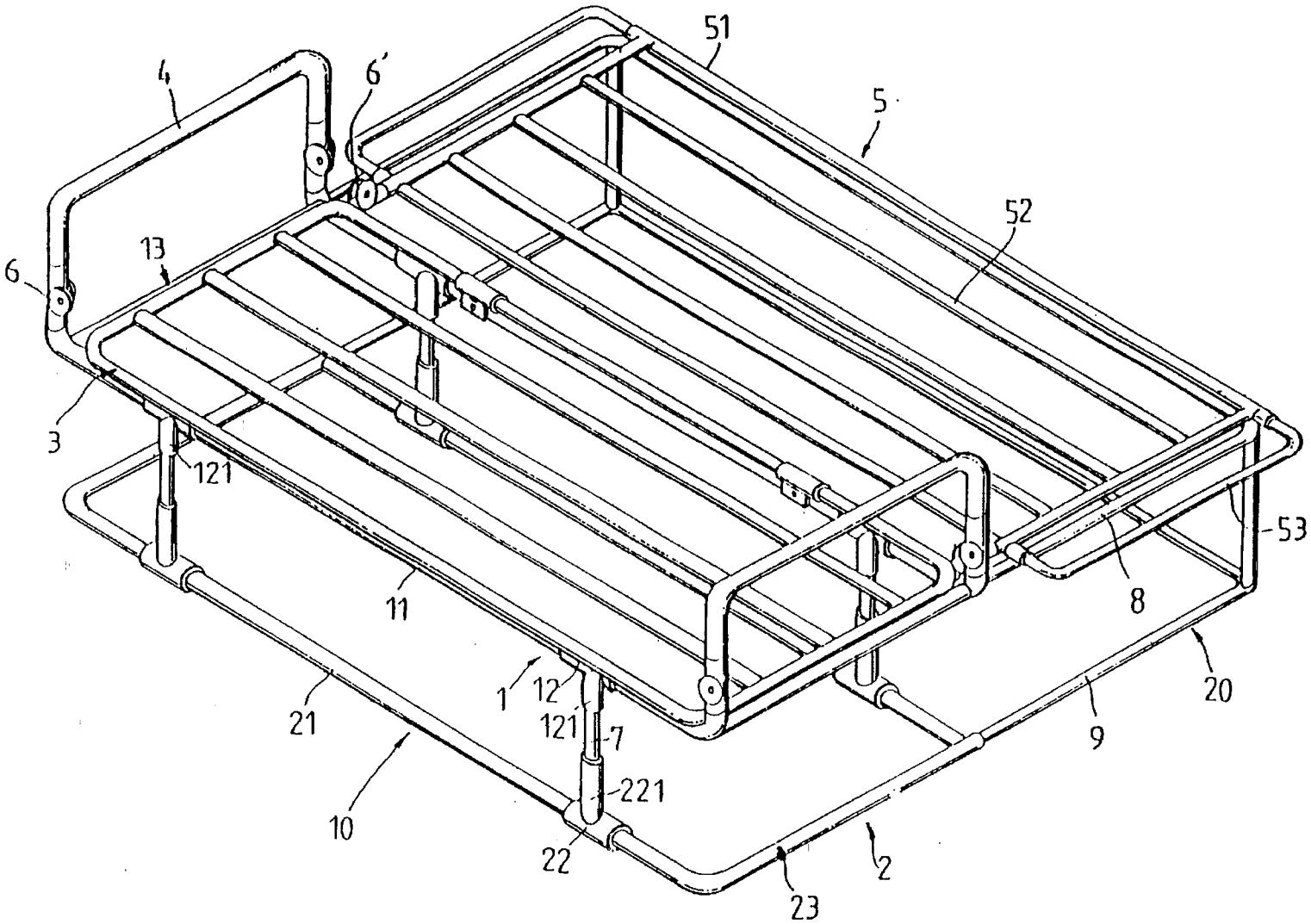
FIG. 2 shows the frame assembly of the sofabed arranged into linked twin beds according to the present invention.
Figure 3:
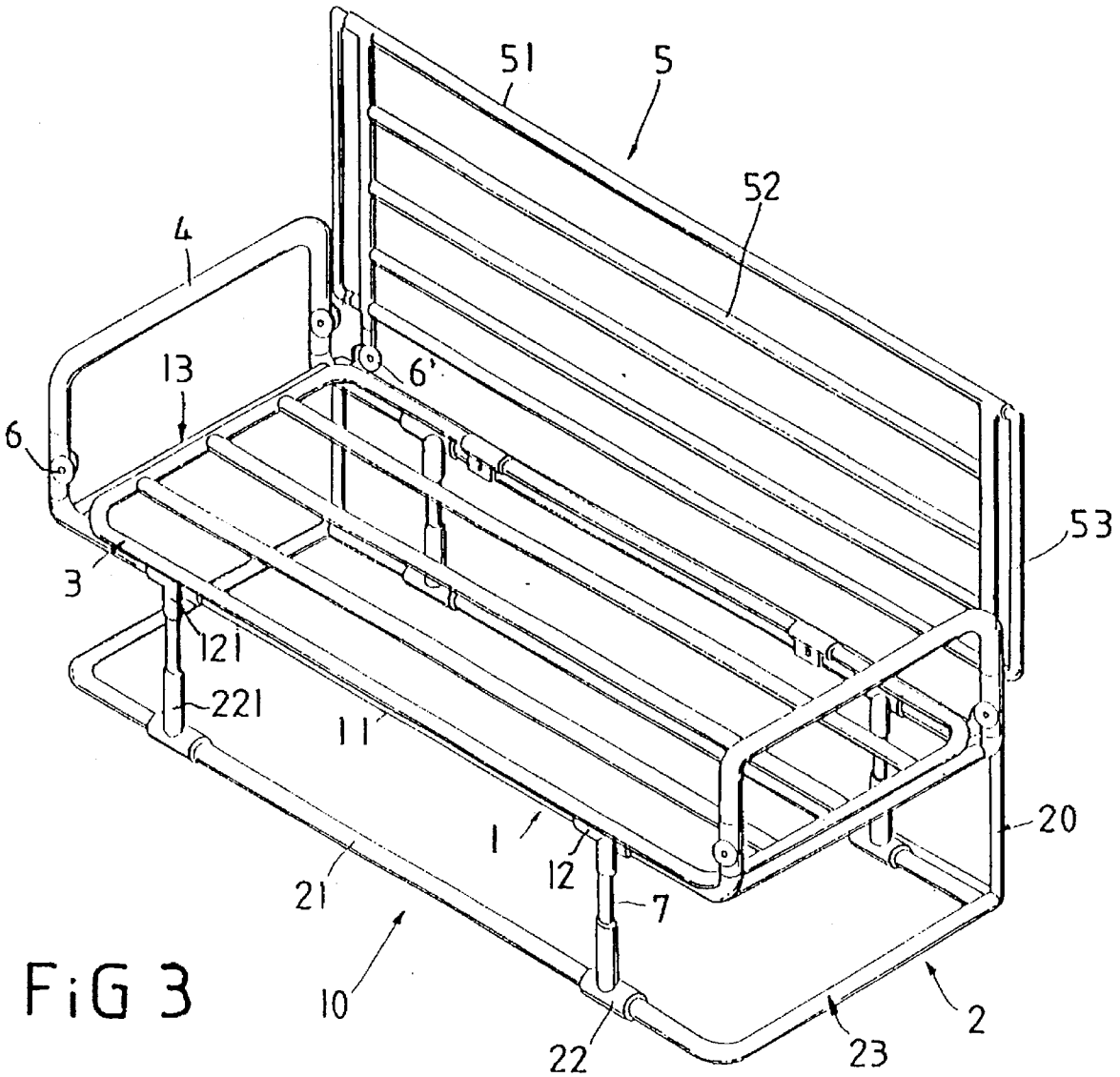
FIG. 3 shows the frame assembly of the sofabed arranged into the form of a sofa according to the present invention.
Figure 4:
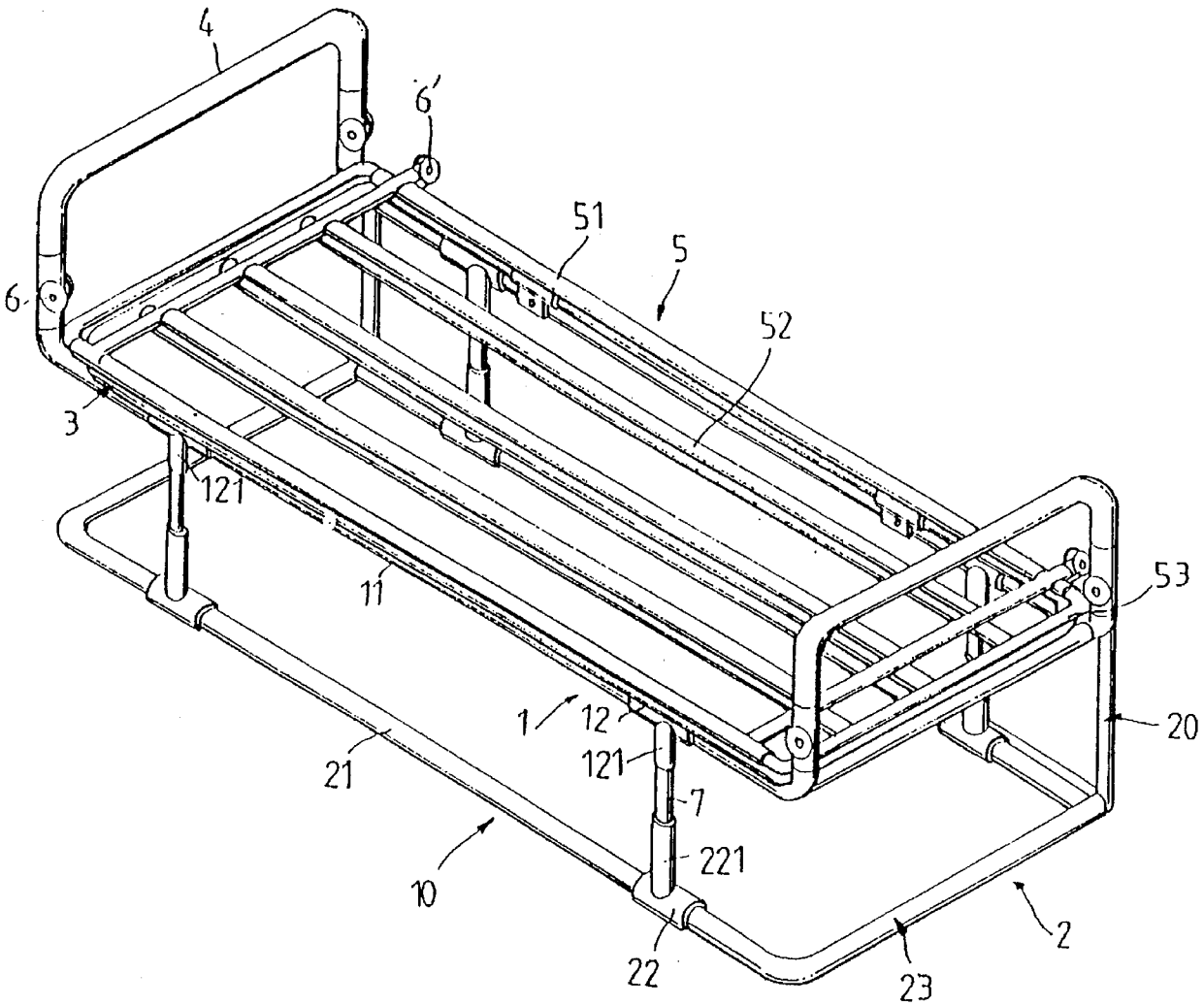
FIG. 4 shows the frame assembly of the sofabed arranged into a single bed according to the present invention.

Referring to FIG. 1 again, the first base frame 10 comprises an upper sub-frame 1 and a bottom sub-frame 2 connected in parallel. The sub-frame 1 or 2 comprises two longitudinal frame tubes 11 or 21 disposed at two opposite sides in a parallel relation, two substantially U-shaped frame tubes 17 or 23 respectively connected between the longitudinal frame tubes 11 or 21 at two opposite ends, arid two pairs of Tees 12 or 22 respectively connected between the longitudinal frame tubes 11 or 21 and the U-shaped frame tubes 13 or 23. Two pairs of connecting tubes 7 are respectively connected between the longitudinal tube sections 121 of the tees 12 of the upper sub-frame 1 and the longitudinal tube sections 221 of the tees 22 of the bottom sub-frame 2 to hold the upper sub-frame 1 above the bottom sub-frame 2 in a parallel relation, so that a storage space is defined between the upper sub-frame 1 and the bottom sub-frame 2 for keeping a quilt, pillow, etc. The U-shaped frame tube 13 or 23 comprises a transverse tube section 132 or 232, and two end tube sections 131 or 231 respectively extending from two opposite ends of the transverse tube section 132 or 232 at right angles and fastened to the respective Tees 12 or 22 of the sub-frame 1 or 2. The U-shaped frame tube 13 of the upper sub-frame 1 comprises two short upright tube sections 133 respectively raised from two opposite ends of the transverse tube section 132 for mounting the connectors 6. Two connectors 6 are respectively fastened to the short upright tube sections 133 of the U-shaped frame tube 13 of the upper sub-frame 1 to hold the armrest frames 4, permitting the armrest frames 4 to be adjusted to the desired angle (for example, 30°, 45°, . . . etc.) relative to the upper sub-frame 1. The transverse tube section 132 or 232 of the U-shaped frame tube 13 or 23 has one end closed, and an opposite end opened for mounting the second base frame 20. The second base frame 20 comprises an u-shaped upper sub-frame 8 and an u-shaped bottom sub-frame 9 connected in parallel. The diameter of the frame tubes of the second base frame 20 is smaller than that of the first base frame 10 so that the second base frame 20 can be inserted into the transverse frame sections 132, 232 of the U-shaped frame tubes 12, 23 of the first base frame 10, and moved between the retracted position as shown in FIGS. 3 and 4 and the extended position as shown in FIGS. 1 and 2. The first seat frame 3 fits over the upper sub-frame 1 of the first base frame 10, comprising a rectangular open frame 31, a plurality of longitudinal frame tubes 32 connected in parallel within the rectangular open frame 31, and a plurality of connecting plates 33 mounted on the rectangular open frame 31 and fixed to the upper sub-frame 1 of the first base frame 10 to serve as the seat of a sofa or the bed piece of a bed. The second seat frame 5 comprises a rectangular open frame 51, a plurality of longitudinal frame tubes 52 connected in parallel within the rectangular open frame 51, and two substantially U-shaped frame tubes 53 retractably connected to the rectangular open frame 51 at two opposite ends. The rectangular open frame 51 has one side pivotably connected to one of the longitudinal frame tubes 11 of the upper sub-frame 1 of the first base frame 10 by connectors 6', which permit the second seat frame 5 to be adjusted to the desired angle (for example, 30°, 45°, 90°, etc.) relative to the upper sub-frame 1 of the first base frame 10.

Referring to FIG. 3, the sofabed can be arranged into a sofa by: retracting the second base frame 20 into the first base frame 10, adjusting the connectors 6 to set the armrest frames 4 in a vertical position perpendicular to the upper sub-frame 1 of the first base frame 10, and adjusting the connectors 6' to set the second seat frame 5 in a vertical position perpendicular to the upper sub-frame 1 of the first base frame 10, permitting the second seat frame 5 to serve as the back of the sofa.

Referring to FIG. 2, the sofabed can be arranged into linked twin beds by: extending the second base frame 20 out of the first base frame 10 to the extended position, and adjusting the connectors 6' to set the second seat frame 5 in a horizontal position supported on the extended second base frame 20. The U-shaped frame tubes 53 may be extended out of the two opposite ends of the rectangular open frame 51 for supporting a tall person on the second seat frame 5. Furthermore, the armrest frames 4 may be adjusted to the horizontal position as desired.

Referring to FIG. 4, the sofabed can be arranged into a single bed by: retracting the second base frame 20 into the first base frame 10, adjusting the connectors 6 to set the armrest frames 4 in a vertical position perpendicular to the upper sub-frame 1 of the first base frame 10, and adjusting the connectors 6' to set the second seat frame 5 in horizontal position closely attached to the first seat frame 3 above the first base frame 10. When set, the armrest frames 4 may the adjusted to the horizontal position or the vertical position as desired.

Figure 5:
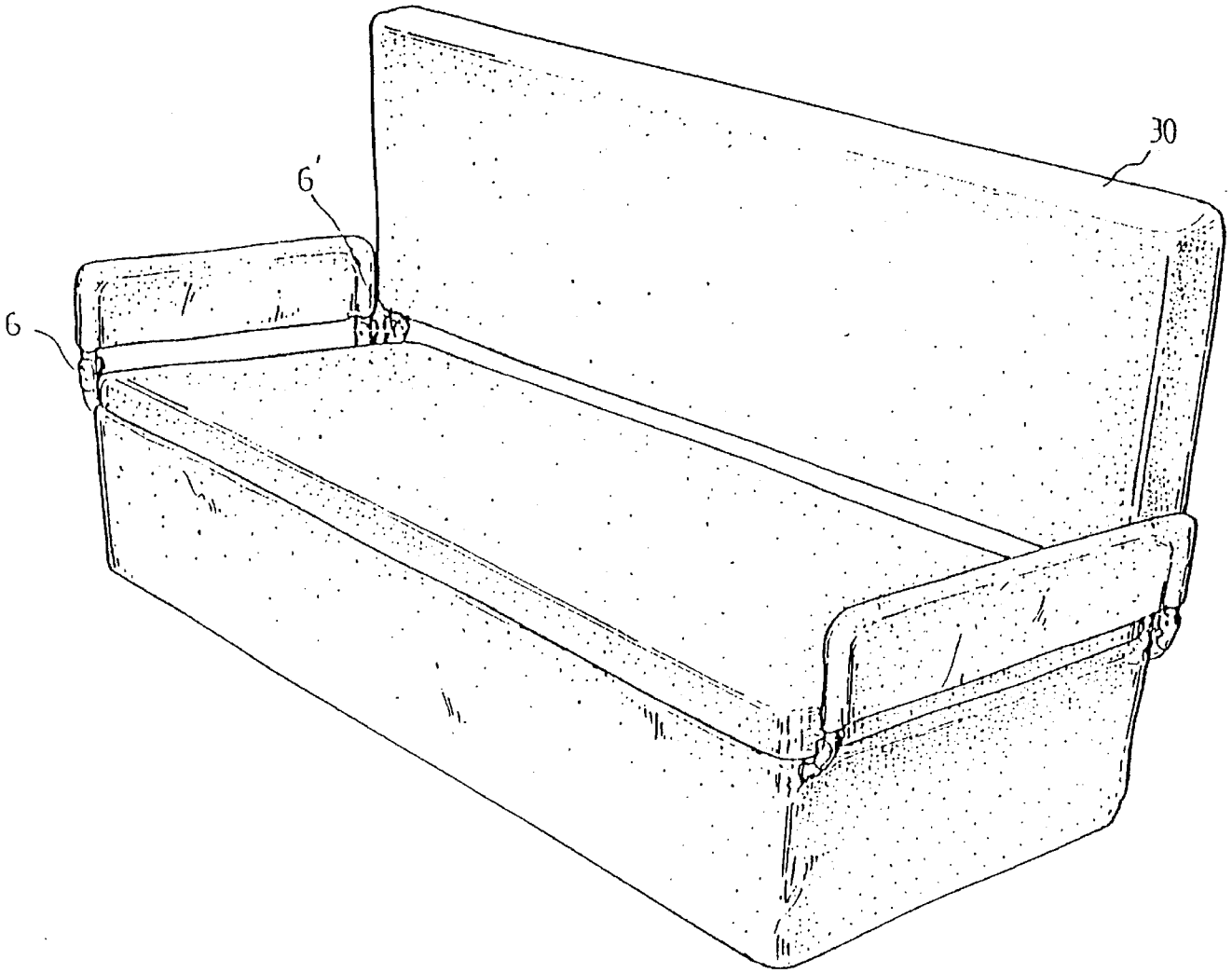
FIG. 5 is an elevation of the sofabed arranged into a sofa according to the present invention.

FIG. 5 shows the first base frame 10, the first seat frame 3, the second seat frame 5, and the two armrest frames 4 of the sofabed are respectively covered with a respective covering 30, and the sofabed set into a sofa.

It is to be understood that the drawings are designed for purposes of illustration only, and are not intended as a definition of the limits and scope of the invention disclosed.

I claim:

1. A sofabed comprising:

a first base frame, said first base frame comprising an upper sub-frame and a bottom sub-frame connected in parallel at different elevations, said upper sub-frame comprising two longitudinal frame tubes disposed at two opposite sides in a parallel relation, two substantially U-shaped frame tubes respectively connected between said longitudinal frame tubes, and two pairs of tees respectively connected between said longitudinal frame robes and said U-shaped frame tubes to support said upper sub-frame above said bottom sub-frame;

at least one armrest frame, a plurality of first pivotal connectors for connecting the armrest frame to a U-Shaped frame robe of the upper sub-frame and permitting pivotal adjustment of a relative angle between the armrest frame and the upper sub-frame;

a first seat frame pivoted to one longitudinal frame tube of the upper sub-frame of said first base frame and fitting over the upper sub-frame of said first base frame; and a second seat frame, a plurality of second pivotal adjustable connectors for connecting the second seat frame to a longitudinal frame tube of the upper sub-frame of the first base frame and permitting pivotal adjustment of the second seat frame relative to the first base frame through an angle within approximately 180 degrees.

2. The sofabed of claim 1 further comprising a second base frame connected to said first base frame, and movable between a retracted position wherein the second base frame is closely received inside said first base frame and an extended position wherein said second seat frame is supported at one side of said first seat frame and with both seat frames being at the same elevation.

3. The sofabed of claim 1 wherein the bottom sub-frame of said first base frame comprises two longitudinal frame tubes, and two pairs of tees respectively mounted on the longitudinal frame tubes of said first base frame at two opposite ends and connected to the tees of the upper sub-frame of said first base frame by respective connecting tubes.

4. The sofabed of claim 1 wherein said second seat frame comprises a rectangular open frame, a plurality of longitudinal frame tubes connected in parallel within said rectangular open frame, and two substantially U-shaped frame tubes retractably connected to said rectangular open frame at two opposite ends.

* * * * *